US012582252B2

(12) United States Patent
Gougian

(10) Patent No.: US 12,582,252 B2
(45) Date of Patent: Mar. 24, 2026

(54) SPOON STRAW DIGIT SUPPORT UTENSIL

(71) Applicant: Susan Lucia Gougian, Pepperell, MA (US)

(72) Inventor: Susan Lucia Gougian, Pepperell, MA (US)

( * ) Notice: Subject to any disclaimer, the term of this patent is extended or adjusted under 35 U.S.C. 154(b) by 164 days.

(21) Appl. No.: 17/902,807

(22) Filed: Sep. 3, 2022

(65) Prior Publication Data

US 2024/0074604 A1 Mar. 7, 2024

(51) Int. Cl.

*A47G 21/18* (2006.01)
*A47G 21/02* (2006.01)
*A47G 21/04* (2006.01)

(52) U.S. Cl.

CPC ..... *A47G 21/181* (2013.01); *A47G 21/02* (2013.01); *A47G 21/04* (2013.01); *A47G 2200/04* (2013.01)

(58) Field of Classification Search

None
See application file for complete search history.

(56) References Cited

U.S. PATENT DOCUMENTS 674,446 A * 5/1901 Marx
838,401 A * 12/1906 Grocott ..... A47G 21/04 30/327
2,012,637 A * 8/1935 Ribley ..... A47G 21/04 D7/681
2,859,515 A * 11/1958 Harold ..... A47G 21/181 30/141
3,648,369 A * 3/1972 Frodsham ..... A47G 21/181 30/141
5,890,223 A * 4/1999 Klemmer ..... A47G 21/02 30/326
D476,863 S * 7/2003 Jagger ..... D7/663
8,769,832 B1 * 7/2014 Joyner ..... A47J 43/28 30/340
2002/0144406 A1 * 10/2002 Coscia ..... A47G 21/181 30/141
2004/0194322 A1 * 10/2004 Bullard ..... A47G 21/02 30/286
2005/0091854 A1 * 5/2005 Johnson ..... A47G 21/00 30/322
2008/0060206 A1 * 3/2008 DeSalvo ..... A47J 43/28 30/327
2015/0320261 A1 * 11/2015 Garrels ..... A47J 43/005 426/304
2021/0068569 A1 * 3/2021 Howell ..... A47G 21/182
2024/0074604 A1 * 3/2024 Gougian ..... A47G 21/02

FOREIGN PATENT DOCUMENTS

BR 202015008984 U2 * 5/2018 ..... A47G 21/181

* cited by examiner

*Primary Examiner* — Hwei-Siu C Payer

(57) ABSTRACT

A combination spoon and straw utensil that is used for the consumption of food and drink. A combination spoon and straw utensil comprising of a single piece of flexible or nonflexible material. A combination spoon and straw utensil comprising of a solid spoon bowl, a hollow handle, a plurality of holes, and a digit support for stabilizing the utensil during use. The spoon and straw utensil having a textured surface for sensory stimulation. The spoon and straw utensil being brightly colored for making the utensil easy to recognize and more visible for users with cognitive decline and visual impairment.

2 Claims, 2 Drawing Sheets

36

SPOON STRAW DIGIT SUPPORT UTENSIL

CROSS-REFERENCE TO RELATED APPLICATIONS

Not Applicable

STATEMENT REGARDING FEDERALLY SPONSORED RESEARCH OF DEVELOPMENT

Not Applicable

REFERENCE TO MICROFICHE APPENDIX

Not Applicable

BACKGROUND OF THE INVENTION

1. Field of the Invention

The present invention relates to a combination spoon and straw utensil that is used for the consumption of food and drink. The present invention relates to a combination spoon and straw utensil comprised of a single piece of flexible or nonflexible material.

2. Description of the Prior Art

Combination spoon and straw utensils in prior art are designed for the consumption of food and drink. Combination spoon and straw utensils in prior art describe liquid entering a compartment under a spoon bowl before moving into a drinking straw. Combination spoon and straw utensils in prior art that have a compartment under a spoon bowl are difficult to sanitize. The present invention does not have a compartment under the spoon bowl, and therefore is easier to sanitize.

3. Objects and Advantages

The present invention is a combination spoon and straw utensil that is used for the consumption of food and drink. The present invention is significantly different from prior art combination spoon and straw utensils. Conventional spoons and straws are difficult for people with cognitive decline, tremors, and visual impairment to use. The present invention is designed to make dining easier for people with cognitive decline, tremors, and visual impairment.

The present invention is a solution to long felt but unsolved need of people with dementia and other memory loss conditions. People with dementia and other memory loss conditions often become confused when using eating and drinking utensils. People that suffer with memory loss may become frustrated when confusing a spoon handle with a drinking straw. An individual with memory loss does not understand why liquid is not flowing through the spoon handle and into his or her mouth when attempting to suck liquid from the end of a spoon handle. The present invention is designed to allow liquid to flow when the user is sucking liquid through the end of the utensil. The present invention helps memory loss sufferers to maintain self-feeding independence while providing a more pleasant dining experience.

People with dementia and other memory loss conditions often experience adverse changes in their eating habits, such as loss of appetite, and eating less food. Sensory stimulation may prompt people with dementia to eat more food. Therefore, sensory stimulation may help people with dementia to maintain a healthy weight. The present invention is designed with a textured surface on the spoon bowl for sensory stimulation.

People with cognitive decline and visual impairment will benefit from the present invention. The present invention being brightly colored for sensory stimulation. The present invention being brightly colored for making the utensil easy to recognize and more visible for users with cognitive decline and visual impairment.

People that suffer with tremors will benefit from the present invention. People with tremors find it difficult to hold eating utensils. The present invention is designed with a wide, easy to hold handle. The present invention is designed with a digit support for stabilizing the utensil during use. A digit support is not seen in prior art. The digit support being used as a thumb support when the utensil is being used as a straw, and the digit support being used as a finger support when the utensil is being used as a spoon.

BRIEF SUMMARY OF THE INVENTION

The present invention is a combination spoon and straw utensil that is used for the consumption of food and drink. The present invention is comprised of a single piece of flexible or nonflexible material. The present invention is comprised of a solid spoon bowl, a hollow handle, a plurality of holes, and a digit support.

The present invention is designed with a solid spoon bowl having a volume of about 4 grams. The solid spoon bowl being used for scooping and eating food. The solid spoon bowl can accommodate foods such as soups, purees, rice, beans, and cereals. The present invention is designed with a hollow handle being used for moving liquids such as water, juice, broth, and milk. The present invention having a plurality of holes for sucking liquid through the hollow handle.

The present invention having a textured surface for sensory stimulation. The present invention having a textured surface comprising of a plurality of bumps, lines, wavy lines, or the like.

The digit support being used for holding the utensil steady during use. The digit support being used as a thumb support when the utensil is being used as a straw, and the digit support being used as a finger support when the utensil is being used as a spoon.

The present invention being brightly colored for sensory stimulation. The present invention being brightly colored for making the utensil easy to recognize and more visible for users with cognitive decline and visual impairment.

NUMBERING OF THE DRAWINGS

Figure 1:
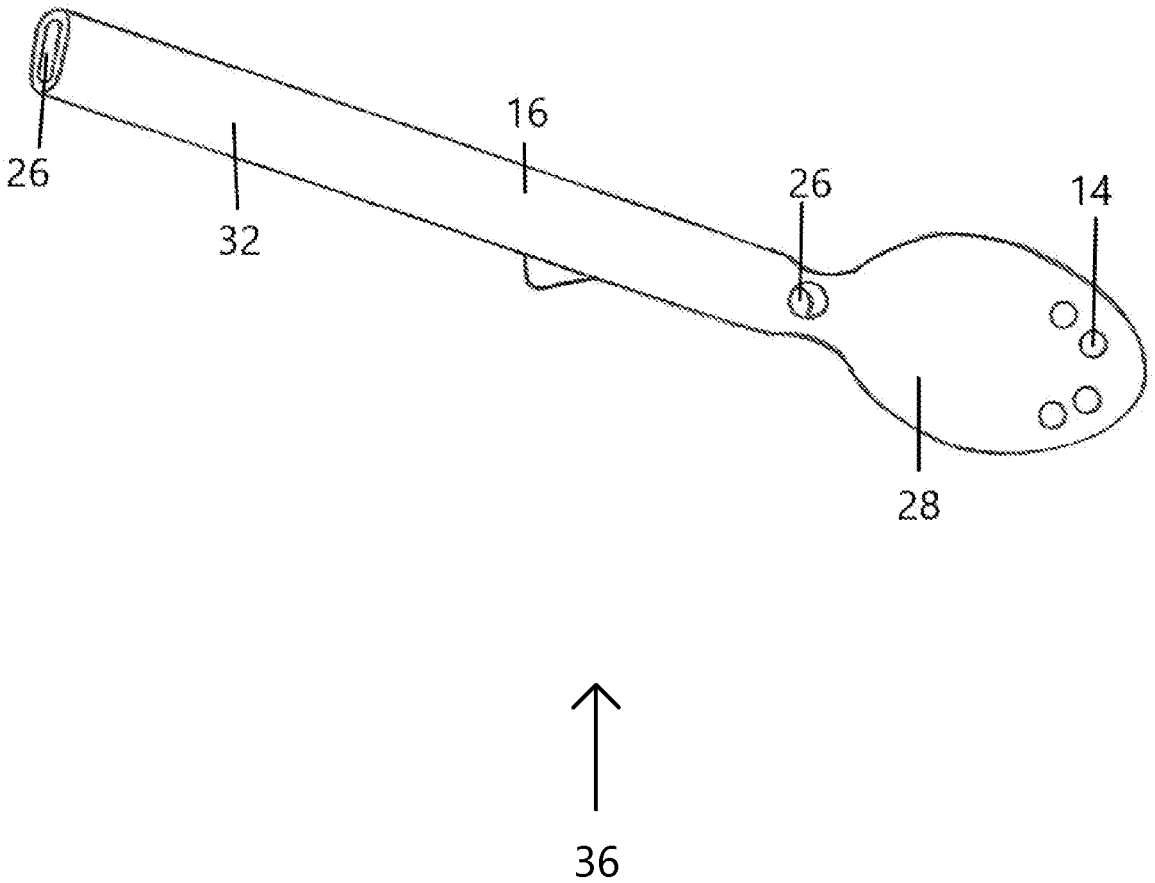
FIG. 1 is a plan view of the front side of the spoon straw digit support utensil.

| | |
|---|---|
| Spoon Straw Digit Support Utensil 36 | Digit support 18 |
| Spoon bowl 28 | Hole 26 |
| Hollow handle 16 | Material 32 |
| Textured surface 14 | |

DETAILED DESCRIPTION OF THE INVENTION

The spoon straw digit support utensil 36 comprising of a single piece of flexible or nonflexible material 32.

Referring to FIG. 1, the material 32 from which the spoon straw digit support utensil 36 is constructed being furnished preferably by a plastic resin. Where a plastic resin is used, an engineering plastic resin that is heat resistant, and provides a slippery, non-stick surface to the finished product should be chosen.

The plastic resin should be chosen from a group of plastic resins including, but not limited to, polyethylene, polypropylene, acrylonitrile butadiene styrene, polytetrafluoroethylene, polyethylene terephthalate glycol, and silicone.

Where a plastic resin is used, a brightly colored plastic resin should be chosen. Where a plastic resin is used, a metal mold is needed to manufacture the spoon straw digit support utensil 36. The metal mold should be made using a tool or a machine well known in the art. The metal mold should have specific dimensions necessary to manufacture the spoon straw digit support utensil 36.

Where a plastic resin is used, plastic resin pellets are preferred. The plastic resin pellets should be poured into a specialized machine well known in the art. The plastic resin pellets should be melted in the specialized machine and molded to manufacture the spoon straw digit support utensil 36.

The preferred dimensions for the spoon straw digit support utensil 36 will be given for instructional purposes but not as a limitation.

The spoon straw digit support utensil 36 being about 7.5 inches in length. The material 32 from which the spoon straw digit support utensil 36 is constructed from being about 1/16 inch in thickness.

The present invention having a solid spoon bowl 28 being about 1.8 inches in length and being about 1.4 inches in width. The solid spoon bowl 28 being about 0.32 inch in depth and having a volume of about 4 grams. The solid spoon bowl 28 being used for scooping and eating food. The solid spoon bowl 28 for accommodating foods such as soups, purees, rice, beans, and cereals.

The present invention having a hollow handle 16 for moving liquids such as water, juice, broth, and milk. The present invention having a wide, easy to hold, hollow handle 16. The present invention having a wide, easy to hold, hollow handle 16 being in the form of a tube. The hollow handle 16 adjoining the spoon bowl 28. The hollow handle 16 providing a drinking straw. The hollow handle 16 being used for moving and drinking liquid.

The hollow handle 16 preferably being rectangular. The hollow handle 16 being about 1/2 inch in width, being about 1/4 inch in depth, and being about 5.5 inches in length. In another embodiment, the hollow handle 16 being round. Where the hollow handle 16 is round, the hollow handle 16 being about 3/8 inch in diameter.

Figure 2:
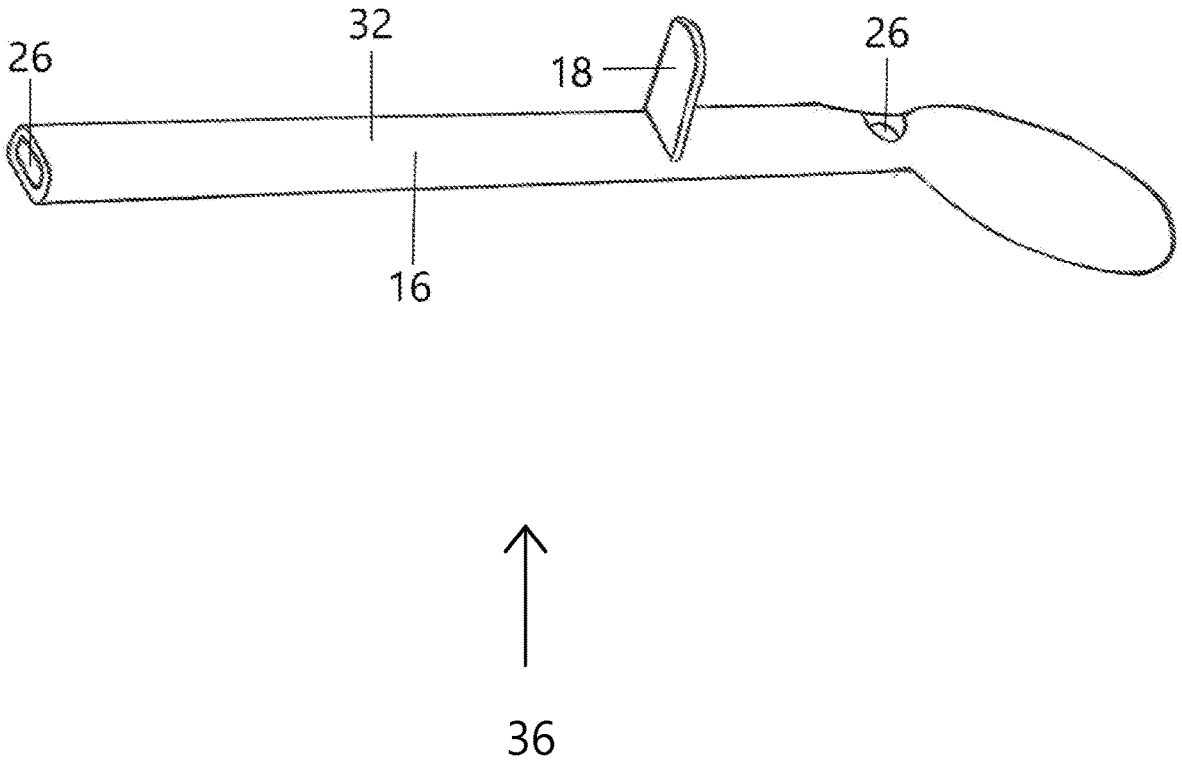
FIG. 2 is a plan view of the back side of the spoon straw digit support utensil.

Referring to the drawings, FIG. 1 is a plan view of the front side of the spoon straw digit support utensil 36. FIG. 2 is a plan view of the back side of the spoon straw digit support utensil 36.

Referring to FIG. 1, the hollow handle 16, through which liquid flows, having an exit hole 26 located at the top end of the hollow handle 16. The exit hole 26 preferably being rectangular. Where the exit hole 26 is rectangular, the hole 26 being about 3/8 inch in length and being about 3/16 in width. In another embodiment, the hole 26 being round. Where the hole 26 is round, the hole 26 being about 3/8 inch in diameter. The exit hole 26 being used for sucking liquids through the hollow handle 16.

Referring to FIG. 1, the hollow handle 16 having a hole 26 at the bottom end of the hollow handle 16 on the front side of the spoon straw digit support utensil 36. The hole 26 being used for liquid to enter and to exit the hollow handle 16. The hole 26 being located about 1/4 inch above the point where the hollow handle 16 is adjoined to the spoon bowl 28. The hole 26 being about 1/4 inch in diameter.

Referring to FIG. 2, the hollow handle 16 having an entrance hole 26 being located near the bottom end of the hollow handle 16 on the back side of the spoon straw digit support utensil 36. The entrance hole 26 being used for liquid to enter the hollow handle 16. The entrance hole 26 being located about 1/4 inch above the point where the hollow handle 16 is adjoined to the spoon bowl 28. The entrance hole 26 being about 1/4 inch in diameter.

Referring to FIG. 2, the spoon straw digit support utensil 36 having a digit support 18. The digit support 18 being located on the back side of the spoon straw digit support utensil 36. The digit support 18 adjoining the rectangular hollow handle 16. The digit support 18 being adjoined about 90 degrees perpendicular to the hollow handle 16.

Referring to FIG. 2, the spoon bowl 28 being adjoined to the rectangular hollow handle 16. The spoon bowl 28 being adjoined to the rectangular hollow handle 16 at a point about 1/4 inch below entrance hole 26. The digit support 18 being located 2 inches above the point where the spoon bowl is adjoined to the rectangular hollow handle 16.

The digit support 18 having a flat top side and a flat bottom side. The digit support 18 preferably being rectangular. Where the digit support 18 is rectangular, the digit support 18 being about 1/2 inch in width and being about 3/4 inch in length. The digit support 18 being about 1/16 inch in thickness. The digit support 18 having rounded edges. In another embodiment, the digit support 18 being located on the front side of the spoon straw digit support utensil 36.

The digit support 18 being used for holding the spoon straw digit support utensil 36 steady during use. The digit support 18 may be used as a thumb support when the utensil is being used as a straw, and the digit support 18 may be used as a finger support when the utensil is being used as a spoon.

Referring to FIG. 1, the spoon straw digit support utensil 36 having a textured surface 14 comprising of a plurality of bumps, lines, wavy lines, or the like. The textured surface 14 being an embossed surface. The textured surface 14 preferably being located on the spoon bowl 28 but may be located on other areas of the spoon straw digit support utensil 36.

The above description of the preferred embodiment of the present invention may be changed or modified by those skilled in the art, to which the invention appertains, without departing from scope of the invention, which is intended to be limited only by the scope of the claims.

I claim:

1. A spoon straw digit support utensil comprising: a solid spoon bowl, a hollow handle, an entrance hole, an exit hole, and a digit support;

said solid spoon bowl for scooping and eating food;

said hollow handle for moving and drinking liquid;

said entrance hole for liquid to enter said hollow handle;

said exit hole for liquid to exit said hollow handle;

said entrance hole and said exit hole for sucking liquid through said hollow handle;

said entrance hole being located on a back side of said hollow handle for preventing confusion between spoon and straw by users with dementia;

said entrance hole being located on the hollow handle above the point where said spoon bowl is adjoined to said hollow handle for preventing food held in said spoon bowl from being sucked into said hollow handle;

said hollow handle being a means to hold said spoon straw digit support utensil;

said hollow handle being rectangular for providing a front side and the back side to said hollow handle;

said digit support being a means to steady said spoon straw digit support utensil during use;

said digit support being located 2 inches above the point where said spoon bowl is adjoined to said rectangular hollow handle for hand to mouth distancing of said spoon straw utensil, and for control and stability of the utensil;

said spoon straw digit support utensil comprising of a single piece of flexible or nonflexible material;

wherein said hollow handle is adjoining said solid spoon bowl;

wherein said digit support is adjoining said hollow handle;

and said digit support being adjoined perpendicular to said hollow handle.

2. A spoon straw digit support utensil of claim 1 further comprising: a textured surface;

said textured surface for sensory stimulation;

and said textured surface comprising of a plurality of bumps or lines.

* * * * *